US009890786B2

(12) United States Patent
Tanaka et al.

(10) Patent No.: US 9,890,786 B2
(45) Date of Patent: Feb. 13, 2018

(54) ROTARY COMPRESSOR HAVING VANE THAT HAS DIAMOND-LIKE CARBON LAYER

(71) Applicant: FUJITSU GENERAL LIMITED, Kawasaki-shi, Kanagawa (JP)

(72) Inventors: Junya Tanaka, Kawasaki (JP); Kenji Komine, Kawasaki (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 118 days.

(21) Appl. No.: 14/898,042

(22) PCT Filed: Jan. 29, 2014

(86) PCT No.: PCT/JP2014/051981

§ 371 (c)(1),
(2) Date: Dec. 11, 2015

(87) PCT Pub. No.: WO2015/045433

PCT Pub. Date: Apr. 2, 2015

(65) Prior Publication Data

US 2016/0138593 A1 May 19, 2016

(30) Foreign Application Priority Data

Sep. 30, 2013 (JP) ..... 2013-205825

(51) Int. Cl.
*F04C 18/356* (2006.01)
*F04C 29/00* (2006.01)
(Continued)

(52) U.S. Cl.
CPC ..... *F04C 18/3564* (2013.01); *C23C 8/04* (2013.01); *C23C 8/26* (2013.01); *C23C 28/044* (2013.01);
(Continued)

(58) Field of Classification Search
CPC .. F04C 18/356–18/3564; F04C 2/356–2/3564; F01C 21/0809
(Continued)

(56) References Cited

U.S. PATENT DOCUMENTS 6,066,399 A 5/2000 Hirano et al.
6,299,425 B1 * 10/2001 Hirano ..... F01C 21/0809 418/152
(Continued)

FOREIGN PATENT DOCUMENTS

CN 1737374 A 2/2006
CN 1982051 A 6/2007
(Continued)

OTHER PUBLICATIONS

Extended European Search Report EP Application No. 14849885.0 dated Apr. 5, 2017.
(Continued)

*Primary Examiner* — Laert Dounis
(74) *Attorney, Agent, or Firm* — McDermott Will & Emery LLP

(57) ABSTRACT

A rotary compressor includes: a compressing unit that includes an annular cylinder, an end plate, an annular piston which is fit in an eccentric portion of a rotation shaft, and a vane which protrudes from the inside of a vane groove of the cylinder to the inside of an operation chamber, comes into contact with the annular piston, and partitions the operation chamber into an inlet chamber and a compression chamber. The vane is formed of steel and has a diamond-like carbon layer formed on a sliding surface with respect to the annular piston. The annular piston is formed of Ni—Cr—Mo cast iron to which 0.15 wt % to 0.45 wt % of phosphorus is added, or is formed of cast iron or steel and has an iron nitride layer formed on an outer circumferential surface thereof.

5 Claims, 3 Drawing Sheets

(51) Int. Cl.

| | |
|---|---|
| ***F01C 21/08*** | (2006.01) |
| ***F04C 29/12*** | (2006.01) |
| ***C23C 8/04*** | (2006.01) |
| ***C23C 8/26*** | (2006.01) |
| ***C23C 28/04*** | (2006.01) |
| *F04C 23/00* | (2006.01) |

(52) U.S. Cl.
CPC ..... *C23C 28/046* (2013.01); *F01C 21/0809* (2013.01); *F04C 29/12* (2013.01); *F04C 23/001* (2013.01); *F04C 23/008* (2013.01); *F04C 2230/91* (2013.01); *F04C 2230/92* (2013.01); *F05C 2201/0406* (2013.01); *F05C 2201/046* (2013.01); *F05C 2201/0409* (2013.01); *F05C 2201/0439* (2013.01); *F05C 2201/0448* (2013.01); *F05C 2201/0466* (2013.01); *F05C 2203/083* (2013.01); *F05C 2203/0808* (2013.01); *F05C 2203/0882* (2013.01); *F05C 2253/12* (2013.01)

(58) Field of Classification Search
USPC ..... 418/178
See application file for complete search history.

(56) References Cited

U.S. PATENT DOCUMENTS

| | | | | |
|---|---|---|---|---|
| 8,585,385 | B2 * | 11/2013 | Watanabe | F04B 39/00 418/11 |
| 2007/0141347 | A1 | 6/2007 | Nakagawa et al. | |
| 2009/0186206 | A1 * | 7/2009 | Ito | C23C 14/0605 428/216 |
| 2011/0027117 | A1 * | 2/2011 | Fujino | F04C 23/008 418/88 |
| 2012/0087822 | A1 | 4/2012 | Nakano et al. | |

FOREIGN PATENT DOCUMENTS

| | | | |
|---|---|---|---|
| CN | 101900108 | A | 12/2010 |
| CN | 202483876 | U | 10/2012 |
| EP | 1798305 | A1 | 6/2007 |
| EP | 2083095 | A2 | 7/2009 |
| JP | H07-217568 | A | 8/1995 |
| JP | H11-264393 | A | 9/1999 |
| JP | 2003-014121 | A | 1/2003 |
| JP | 2006-77582 | A | 3/2006 |
| JP | 2007-162099 | A | 6/2007 |
| JP | 2009-167512 | A | 7/2009 |
| JP | 2011-001598 | A | 1/2011 |
| JP | 2012-237197 | A | 12/2012 |
| JP | 2014-095291 | A | 5/2014 |
| WO | 2010147235 | A2 | 12/2010 |

OTHER PUBLICATIONS

Takanori Takeno et al., "Deposition of DLC film with adhesive W-DLC layer on stainless steel and its tribological properties", Diamond & Related Materials 18 (2009), pp. 1023-1027.

International Search Report dated Mar. 25, 2014, received in related International Application No. PCT/JP2014/051981, filed Jan. 29, 2014 (translation is provided).

First Office Action issued in Chinese Patent Application No. 201480025089.5 dated Aug. 3, 2016 (English language translation is provided).

* cited by examiner

[FIG. 1]
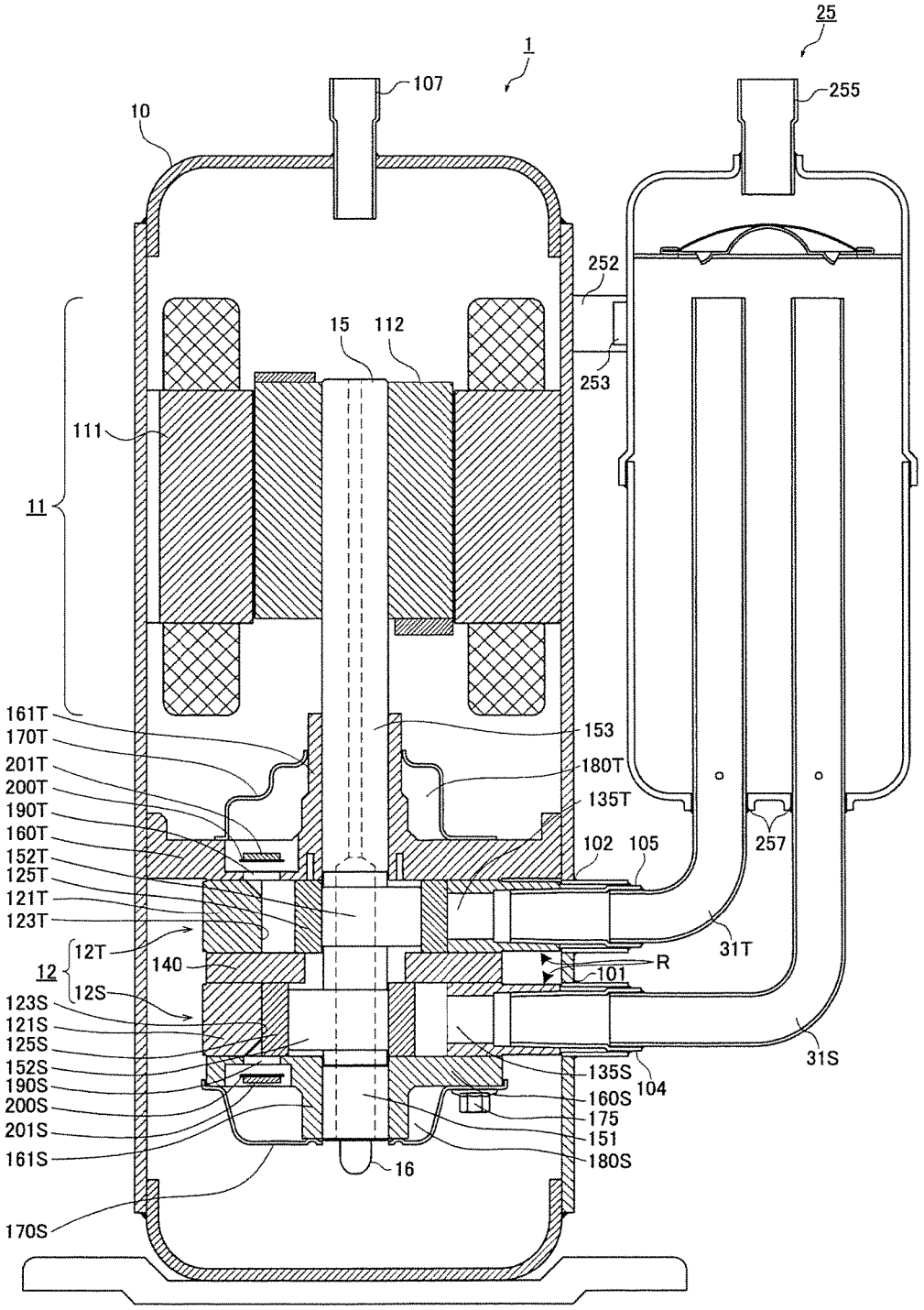

[FIG. 2]
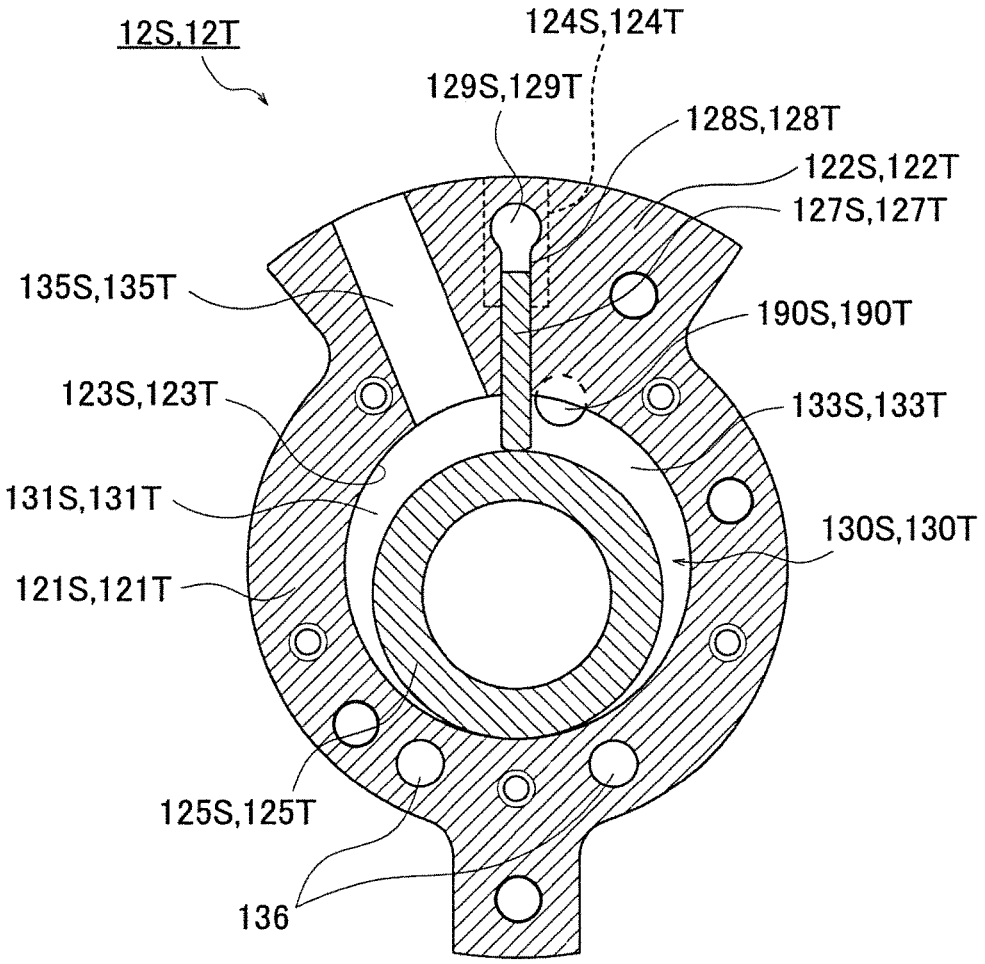

[FIG. 3]
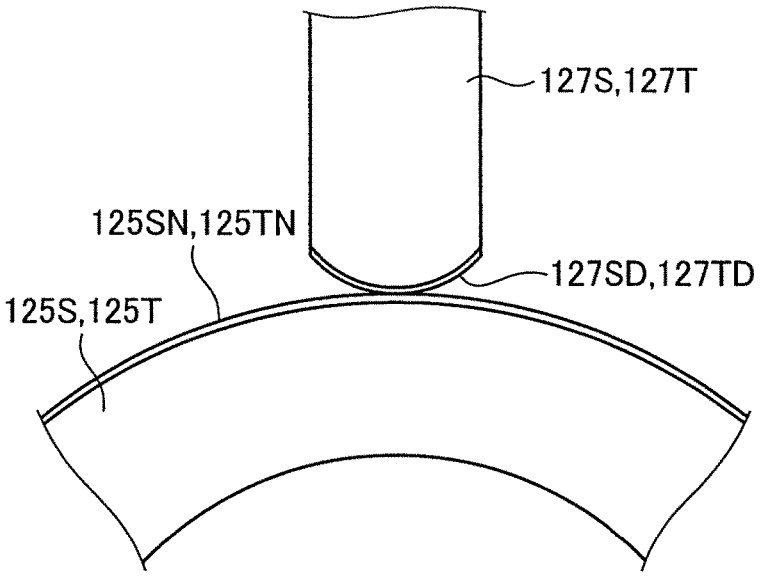
[FIG. 4]
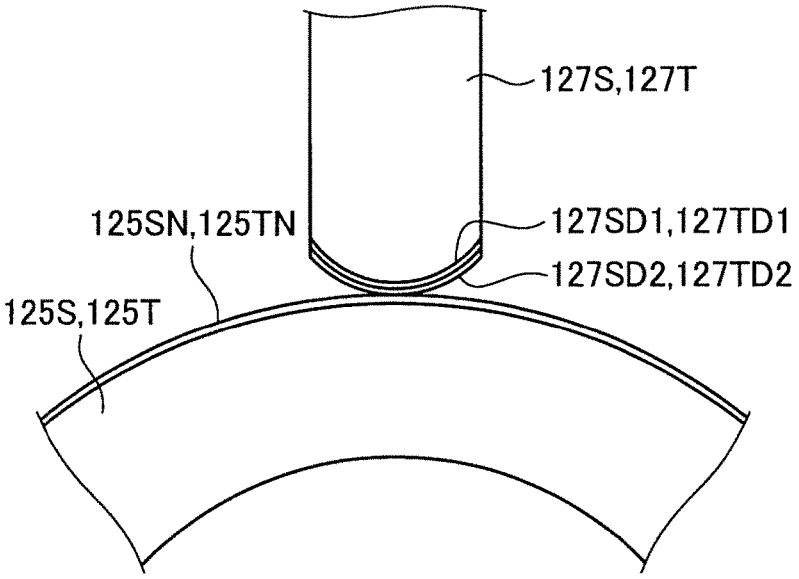

ROTARY COMPRESSOR HAVING VANE THAT HAS DIAMOND-LIKE CARBON LAYER

CROSS-REFERENCE

This application is the U.S. National Phase under 35 U.S.C. § 371 of International Application No. PCT/JP2014/051981, filed Jan. 29, 2014, which claims the benefit of Japanese Application No. 2013-205825, filed Sep. 30, 2013, the entire contents of each are hereby incorporated by reference.

TECHNICAL FIELD

The present invention relates to a rotary compressor that is used in an air conditioner or a refrigerating machine.

BACKGROUND ART

In the related art, a compressor (rotary compressor) which is provided in a refrigeration cycle and compresses and circulates a fluorocarbon refrigerant which does not contain chlorine is disclosed, in which, of sliding members which configure a compressing mechanism, a base member of a blade (vane) is made of a ferrous metal, a chromium nitride layer is formed on a surface of the base member, an iron nitride layer which contains chromium nitride is formed as a joint layer between the base member and the chromium nitride layer, and a roller (annular piston) as a counterpart member is formed of Ni—Cr—Mo cast iron (for example, see PTL 1).

CITATION LIST

Patent Literature

PTL 1: JP-A-7-217568

SUMMARY OF INVENTION

Technical Problem

However, when an air conditioner using the rotary compressor in the related art described above is used as a heater at a low outside temperature, the air conditioner is operated under operation conditions of low inlet pressure of a refrigerant, a high compression ratio, and a high discharge temperature. In a case where the rotary compressor is operated with a discharge temperature above 115° C., a problem arises in that abnormal wear of the annular piston made of the Ni—Cr—Mo cast iron occurs.

The present invention is performed by taking the above problems into account and has an object to achieve a rotary compressor in which abnormal wear of the annular piston does not occur even in a case where a refrigerant discharge temperature of the rotary compressor exceeds 115° C. during operation.

Solution to Problem

In order to solve the above problems and to achieve the object, a rotary compressor of the present invention includes a compressor housing, a compressing unit, and a motor. The compressor housing is a vertically-positioned airtight compressor housing having an upper section in which a discharge portion of a refrigerant is provided and a lower section in which an inlet unit of the refrigerant is provided on a side surface thereof. The compressing unit is disposed in the lower section of the compressor housing and includes an annular cylinder, an end plate which has a bearing unit and a discharge valve unit and closes an end portion of the cylinder, an annular piston which is fit in an eccentric portion of a rotation shaft supported in the bearing unit, performs an orbital motion inside the cylinder along a cylinder inner wall of the cylinder, and forms an operation chamber together with the cylinder inner wall, and a vane which protrudes from the inside of a vane groove of the cylinder to the inside of the operation chamber, comes into contact with the annular piston, and partitions the operation chamber into an inlet chamber and a compression chamber and the compressing unit performs suction of the refrigerant via the inlet unit and discharges the refrigerant from the discharge portion via the inside of the compressor housing. The motor is disposed in the upper section of the compressor housing and drives the compressing unit via the rotation shaft. Further, the vane is formed of steel and has a diamond-like carbon layer formed on a sliding surface with respect to the annular piston. The annular piston is formed of Ni—Cr—Mo cast iron to which 0.15 wt % to 0.45 wt % of phosphorus is added or the annular piston is formed of cast iron or steel and has an iron nitride layer formed on an outer circumferential surface thereof.

Advantageous Effects of Invention

According to the present invention, the effect that abnormal wear of the annular piston does not occur even in a case where a refrigerant discharge temperature of a rotary compressor exceeds 115° C. during operation is achieved.

BRIEF DESCRIPTION OF DRAWINGS

FIG. 1 is a vertical cross-sectional view illustrating an example of a rotary compressor according to the present invention.

FIG. 2 is a horizontal cross-sectional view of first and second compressing units according to the example when viewed from above.

FIG. 3 is a partial cross-sectional view illustrating a sliding portion of first and second annular pistons and first and second vanes of Example 1.

FIG. 4 is a partial cross-sectional view illustrating a sliding portion of first and second annular pistons and first and second vanes of Example 2.

DESCRIPTION OF EMBODIMENTS

Hereinafter, an example of a rotary compressor according to the present invention will be described in detail based on the drawings. The invention is not limited to the example.

Example 1

FIG. 1 is a vertical cross-sectional view illustrating an example of a rotary compressor according to the present invention. FIG. 2 is a horizontal cross-sectional view of first and second compressing units according to the example when viewed from above.

As illustrated in FIG. 1, a rotary compressor 1 of the example includes a compressing unit 12 that is disposed in the lower section of a vertically-positioned airtight compressor housing 10 which has a cylindrical shape and a motor 11 that is disposed in the upper section of the compressor housing 10 and drives the compressing unit 12 via a rotation shaft 15.

A stator 111 of the motor 11 is formed in a cylindrical shape and is shrink-fitted and fixed in the inner circumferential surface of the compressor housing 10. A rotor 112 of the motor 11 is disposed inside the cylindrical stator 111 and is shrink-fitted and fixed to the rotation shaft 15 that mechanically connects the motor 11 with the compressing unit 12.

The compressing unit 12 includes a first compressing unit 12S and a second compressing unit 12T that is disposed in parallel with the first compressing unit 12S and is stacked on the first compressing unit 12S. As illustrated in FIG. 2, the first and second compressing units 12S and 12T include annular first and second cylinders 121S and 121T in which first and second inlet holes 135S and 135T that are radially disposed and first and second vane grooves 128S and 128T are provided in first and second side-flared portions 122S and 122T.

As illustrated in FIG. 2, circular first and second cylinder inner walls 123S and 123T are formed in the first and second cylinders 121S and 121T so as to be concentric with the rotation shaft 15 of the motor 11. First and second annular pistons 125S and 125T which have an outer diameter smaller than an inner diameter of the cylinder are provided inside the first and second cylinder inner walls 123S and 123T, respectively. In this manner, first and second operation chambers 130S and 130T which suck in, compress, and discharge a refrigerant gas are formed between the first and second cylinder inner walls 123S and 123T and the first and second annular pistons 125S and 125T.

The first and second vane grooves 128S and 128T are formed over the entire cylinder height of the first and second cylinders 121S and 121T in a radial direction from the first and second cylinder inner walls 123S and 123T. In addition, first and second vanes 127S and 127T, each of which has a plate shape, are slidably fit in the first and second vane grooves 128S and 128T.

As illustrated in FIG. 2, first and second spring bores 124S and 124T are formed in a deep portion of the first and second vane grooves 128S and 128T such that communication from the outer circumferential portions of the first and second cylinders 121S and 121T to the first and second vane grooves 128S and 128T is performed. First and second vane springs (not illustrated) which press the back surface of the first and second vanes 127S and 127T are inserted into the first and second spring bores 124S and 124T.

When the rotary compressor 1 is started, the first and second vanes 127S and 127T protrude from the inside of the first and second vane grooves 128S and 128T to the inside of the first and second operation chambers 130S and 130T due to bounces of the first and second vane springs. This allows ends of the vanes to come into contact with the outer circumferential surfaces of the first and second annular pistons 125S and 125T and the first and second vanes 127S and 127T to partition the first and second operation chambers 130S and 130T into first and second inlet chambers 131S and 131T and first and second compression chambers 133S and 133T.

In addition, the refrigerant gas compressed in the compressor housing 10 is guided into the first and second cylinders 121S and 121T by communicating the deep portion of the first and second vane grooves 128S and 128T with the inside of the compressor housing 10 via an opening R illustrated in FIG. 1. First and second pressure guiding-in paths 129S and 129T which cause back pressures to be applied by the pressure of the refrigerant gas are formed in the first and second vanes 127S and 127T.

The first and second inlet holes 135S and 135T which cause the first and second inlet chambers 131S and 131T to communicate with the outside are provided in the first and second cylinders 121S and 121T such that a refrigerant is sucked into the first and second inlet chambers 131S and 131T from the outside.

In addition, as illustrated in FIG. 1, an intermediate partition plate 140 is disposed between the first cylinder 121S and the second cylinder 121T and partitions and closes the first operation chamber 130S (refer to FIG. 2) of the first cylinder 121S from the second operation chamber 130T (refer to FIG. 2) of the second cylinder 121T. A lower end plate 160S is disposed on a lower end portion of the first cylinder 121S and closes the first operation chamber 130S of the first cylinder 121S. In addition, an upper end plate 160T is disposed on an upper end portion of the second cylinder 121T and closes the second operation chamber 130T of the second cylinder 121T.

A sub-bearing unit 161S is formed on the lower end plate 160S and a sub-shaft unit 151 of the rotation shaft 15 is rotatably supported in the sub-bearing unit 161S. A main-bearing unit 161T is formed on the upper end plate 160T and a main-shaft unit 153 of the rotation shaft 15 is rotatably supported in the main-bearing unit 161T.

The rotation shaft 15 includes a first eccentric portion 152S and a second eccentric portion 152T which are eccentric by a 180° phase shift from each other. The first eccentric portion 152S is rotatably fit in the first annular piston 125S of the first compressing unit 12S. The second eccentric portion 152T is rotatably fit in the second annular piston 125T of the second compressing unit 12T.

When the rotation shaft 15 rotates, the first and second annular pistons 125S and 125T make orbital motions inside the first and second cylinders 121S and 121T along the first and second cylinder inner walls 123S and 123T in a counterclockwise direction in FIG. 2. Accordingly, the first and second vanes 127S and 127T perform reciprocal motions. The motions of the first and second annular pistons 125S and 125T and the first and second vanes 127S and 127T cause volumes of the first and second inlet chambers 131S and 131T and the first and second compression chambers 133S and 133T to be continually changed. In this manner, the compressing unit 12 continually sucks in, compresses, and discharges the refrigerant gas.

As illustrated in FIG. 1, a lower muffler cover 170S is disposed on the lower side of the lower end plate 160S and a lower muffler chamber 180S is formed between the lower end plate 160S and the lower muffler cover 170S. The first compressing unit 12S opens to the lower muffler chamber 180S. That is, a first outlet 190S (refer to FIG. 2) through which the first compression chamber 133S of the first cylinder 121S communicates with the lower muffler chamber 180S is provided in the vicinity of the first vane 127S of the lower end plate 160S. A first discharge valve 200S which prevents the compressed refrigerant gas from flowing backward is disposed in the first outlet 190S.

The lower muffler chamber 180S is a single annular chamber. The lower muffler chamber 180S is a part of a communication path through which a discharge side of the first compressing unit 12S communicates with the inside of the upper muffler chamber 180T by passing through a refrigerant path 136 (refer to FIG. 2) which penetrates the lower end plate 160S, the first cylinder 121S, the intermediate partition plate 140, the second cylinder 121T and the upper end plate 160T. The lower muffler chamber 180S causes pressure pulsation of the discharged refrigerant gas to be reduced. A first discharge valve cover 201S which controls an amount of flexural valve opening of the first discharge valve 200S is stacked on the first discharge valve 200S and is fixed to the first discharge valve 200S using a rivet. The first outlet 190S, the first discharge valve 200S, and the first discharge valve cover 201S configure a first discharge valve unit of the lower end plate 160S.

As illustrated in FIG. 1, an upper muffler cover 170T is disposed on the upper side of the upper end plate 160T and the upper muffler chamber 180T is formed between the upper end plate 160T and the upper muffler cover 170T. A second outlet 190T (refer to FIG. 2) through which the second compression chamber 133T of the second cylinder 121T communicates with the upper muffler chamber 180T is provided in the vicinity of the second vane 127T of the upper end plate 160T. A reed valve type second discharge valve 200T which prevents the compressed refrigerant gas from flowing backward is disposed in the second outlet 190T. In addition, a second discharge valve cover 201T which controls an amount of flexural valve opening of the second discharge valve 200T is stacked on the second discharge valve 200T and is fixed using a rivet with the second discharge valve 200T. The upper muffler chamber 180T causes pressure pulsation of discharged refrigerant to be reduced. The second outlet 190T, the second discharge valve 200T, and the second discharge valve cover 201T configure a second discharge valve unit of the upper end plate 160T.

The first cylinder 121S, the lower end plate 160S, the lower muffler cover 170S, the second cylinder 121T, the upper end plate 160T, the upper muffler cover 170T, and the intermediate partition plate 140 are integrally fastened using a plurality of penetrating bolts 175 or the like. The outer circumferential portion of the upper end plate 160T of the compressing unit 12 which is integrally fastened using the penetrating bolts 175 or the like is firmly fixed to the compressor housing 10 through spot welding. This allows the compressing unit 12 to be fixed to the compressor housing 10.

First and second through holes 101 and 102 are provided in the outer-side wall of the cylindrical compressor housing 10 at an interval in an axial direction in this order from a lower section thereof so as to communicate with first and second inlet pipes 104 and 105, respectively. In addition, outside the compressor housing 10, an accumulator 25 which is formed of a separate airtight cylindrical container is held by an accumulator holder 252 and an accumulator band 253.

A system connecting pipe 255 which is connected to an evaporator in a refrigeration cycle is connected at the center of the top portion of the accumulator 25. First and second low-pressure communication tubes 31S and 31T, each of which has one end extending toward the upward side inside the accumulator 25, and which have the other ends connected to one ends of the first and second inlet pipes 104 and 105, are connected to a bottom through hole 257 provided in the bottom of the accumulator 25.

The first and second low-pressure communication tubes 31S and 31T which guide a low pressure refrigerant in the refrigeration cycle to the first and second compressing units 12S and 12T via the accumulator 25 are connected to the first and second inlet holes 135S and 135T (refer to FIG. 2) of the first and second cylinders 121S and 121T via the first and second inlet pipes 104 and 105 as an inlet unit. That is, the first and second inlet holes 135S and 135T are connected to the evaporator of the refrigeration cycle in parallel.

A discharge pipe 107 as a discharge portion which is connected to the refrigeration cycle and discharges a high pressure refrigerant gas to a side of a condenser in the refrigeration cycle is connected to the top portion of the compressor housing 10. That is, the first and second outlets 190S and 190T are connected to the condenser in the refrigeration cycle.

Lubricant oil is sealed in the compressor housing 10 substantially to the elevation of the second cylinder 121T. In addition, the lubricant oil is sucked up from a lubricating pipe 16 attached to the lower end portion of the rotation shaft 15, using a pump blade (not illustrated) which is inserted into the lower section of the rotation shaft 15. The lubricant oil circulates through the compressing unit 12. This allows sliding components to be lubricated and the lubricant oil to seal a fine gap in the compressing unit 12.

Next, a characteristic configuration of the rotary compressor of the example will be described with reference to FIG. 3. FIG. 3 is a partial cross-sectional view illustrating a sliding portion of the first and second annular pistons and the first and second vanes of Example 1. As illustrated in FIG. 3, the first and second vanes 127S and 127T of Example 1 have base members, respectively, which are made of steel such as high-speed tool steel (SKH) or stainless steel (SUS). In addition, diamond-like carbon layers (DLC layers) 127SD and 127TD are formed on sliding surfaces (end surfaces) with respect to the first and second annular pistons 125S and 125T, respectively. It is possible to form the DLC layers 127SD and 127TD using an ionized deposition method which is a plasma process under high vacuum. The diamond-like carbon layers (DLC layers) 127SD and 127TD have a diamond bond (SP3: high hardness substance) and a graphite bond (SP2: low hardness and low friction substance). A ratio of a diamond bond (SP3)/a graphite bond (SP2) of the DLC layers 127SD and 127TD described above is 6 to 10 and micro-Vickers hardness thereof is HmV of 1500 or higher.

Even though wear-resistance is improved by the DLC layer, insufficient adhesion between the DLC layer and the base member results in peeling-off of the DLC layer. Hence, between the DLC layer and the base member, a DLC layer of which a ratio of SP3/SP2 is 5 or less or either a CrN layer or a nitride layer is formed as a joint layer. When the joint layer is formed, the hardness changes by small degrees between the DLC layer, the joint layer, and the base member and thus, it is possible to improve adhesion of the DLC layer to the base member.

The first and second annular pistons 125S and 125T of Example 1 are formed using, as a material, Ni—Cr—Mo cast iron to which 0.15 wt % to 0.45 wt % of phosphorus (P) is added. When phosphorus is added to cast iron, a large amount of very hard steadite (P+Fe+C) is generated and wear-resistance is improved. However, since the great amount of steadite results in deterioration of machinability, the upper limit of an amount of phosphorus to be added is set to 0.45 wt %.

In addition, the base members of the first and second annular pistons 125S and 125T may be formed of cast iron or steel and iron nitride layers 125SN and 125TN (refer to FIG. 3) may be formed on outer circumferential surfaces of the pistons. A nitriding treatment is performed on the first and second annular pistons 125S and 125T and thereby, wear-resistance is improved. The nitriding treatment as ion nitriding is performed only on the outer circumferential surfaces. The nitriding treatment is not performed on inner circumferential surfaces of the first and second annular pistons 125S and 125T and abnormal wear of the first and second eccentric portions 152S and 152T of the rotation shaft 15 which slide on the inner circumferential surfaces is prevented.

Example 2

Next, a characteristic configuration of the rotary compressor of Example 2 will be described with reference to FIG. 4. FIG. 4 is a partial cross-sectional view illustrating a sliding portion of first and second annular pistons and first and second vanes of Example 2. As illustrated in FIG. 4, the first and second vanes 127S and 127T of Example 2 have base members, respectively, which are made of steel such as high-speed tool steel (SKH) or stainless steel (SUS). In addition, DLC layers 127SD1 and 127TD1 having HmV of 1500 or higher are formed as under layers on sliding surfaces (end surfaces) with respect to the first and second annular pistons 125S and 125T. Further, DLC layers 127SD2 and 127TD2 having HmV of 1200 or lower are formed as fitness layers on the outer sides of the DLC layers 127SD1 and 127TD1 as the under layers.

The DLC layers 127SD2 and 127TD2 having HmV of 1200 or lower as the fitness layers have the diamond bond (SP3) and the graphite bond (SP2) and a metal or other elements such as tungsten (W), silicon (Si), or nitrogen (n) is added thereto. In this manner, the hardness is further decreased than the under layers and the fitness layer becomes a soft layer, wear of the soft layer due to sliding causes a fine protrusion to be removed or one-side contact not to occur, surface pressure during the sliding is decreased, and seizing or abnormal wear is prevented.

In addition, a ratio of SP3/SP2 of the DLC layers 127SD1 and 127TD1 having HmV of 1500 or higher as the under layers is 6 to 10. The ratio of SP3/SP2 of the DLC layers 127SD2 and 127TD2 having HmV of 1200 or lower as the fitness layers is 5 or less and the DLC layers 127SD2 and 127TD2 may be the soft layers having hardness lower than the under layers.

Even though wear-resistance is improved by the DLC layer, insufficient adhesion between the DLC layer and the base member results in peeling-off of the DLC layer. Hence, between the DLC layer and the base member, a DLC layer of which a ratio of SP3/SP2 is 5 or less or either a CrN layer or a nitride layer is formed as a joint layer. In this manner, it is possible to improve adhesion of the DLC layer to the base member.

The first and second annular pistons 125S and 125T of Example 2 are formed using, as a material, Ni—Cr—Mo cast iron or Ni—Cr—Mo cast iron to which 0.15 wt % to 0.45 wt % of phosphorus (P) is added. In addition, the base members of the first and second annular pistons 125S and 125T may be formed of cast iron or steel and iron nitride layers 125SN and 125TN (refer to FIG. 4) may be formed on outer circumferential surfaces of the pistons. The nitriding treatment as ion nitriding is performed only on the outer circumferential surfaces. The nitriding treatment is not performed on inner circumferential surfaces of the first and second annular pistons 125S and 125T and abnormal wear of the first and second eccentric portions 152S and 152T of the rotation shaft 15 which slide on the inner circumferential surfaces is prevented.

The first and second vanes 127S and 127T of Example 1 or Example 2 which have the sliding surfaces on which the DLC layers are provided and the first and second annular pistons 125S and 125T of Example 1 or Example 2 are combined to be used and thereby, abnormal wear of the first and second annular pistons 125S and 125T does not occur even in a case where a refrigerant discharge temperature of the rotary compressor 1 exceeds 115° C. during operation.

REFERENCE SIGNS LIST

1 rotary compressor
10 compressor housing
11 motor
12 compressing unit
15 rotation shaft
16 lubricating pipe
25 accumulator
31S first low-pressure communication tube
31T second low-pressure communication tube
101 first through hole
102 second through hole
104 first inlet pipe
105 second inlet pipe
107 discharge pipe (discharge portion)
111 stator
112 rotor
12S first compressing unit
12T second compressing unit
121S first cylinder (cylinder)
121T second cylinder (cylinder)
122S first side-flared portion
122T second side-flared portion
123S first cylinder inner wall (cylinder inner wall)
123T second cylinder inner wall (cylinder inner wall)
124S first spring bore
124T second spring bore
125S first annular piston (annular piston)
125T second annular piston (annular piston)
125SN, 125TN iron nitride layer
127S first vane (vane)
127T second vane (vane)
127SD, 127TD diamond-like carbon layer (DLC layer)
127SD1, 127TD1 under layer (DLC layer)
127SD2, 127TD2 fitness layer (DLC layer)
128S first vane groove (vane groove)
128T second vane groove (vane groove)
129S first pressure guiding-in path
129T second pressure guiding-in path
130S first operation chamber (operation chamber)
130T second operation chamber (operation chamber)
131S first inlet chamber (inlet chamber)
131T second inlet chamber (inlet chamber)
133S first compression chamber (compression chamber)
133T second compression chamber (compression chamber)
135S first inlet hole (inlet hole)
135T second inlet hole (inlet hole)
136 refrigerant path
140 intermediate partition plate
151 sub-shaft unit
152S first eccentric portion (eccentric portion)
152T second eccentric portion (eccentric portion)
153 main-shaft unit
160S lower end plate (end plate)
160T upper end plate (end plate)
161S sub-bearing unit
161T main-bearing unit
170S lower muffler cover
170T upper muffler cover
175 penetrating bolt
180S lower muffler chamber
180T upper muffler chamber

190S first outlet (outlet)
190T second outlet (outlet)
200S first discharge valve
200T second discharge valve
201S first discharge valve cover
201T second discharge valve cover
252 accumulator holder
253 accumulator band
255 system connecting pipe
R opening

The invention claimed is:

1. A rotary compressor comprising:

a vertically-positioned airtight compressor housing having an upper section in which a discharge portion of a refrigerant is provided and a lower section in which an inlet unit of the refrigerant is provided on a side surface thereof;

a compressing unit that is disposed in the lower section of the compressor housing, that includes an annular cylinder, an end plate which has a bearing unit and a discharge valve unit and closes an end portion of the cylinder, an annular piston which is fit in an eccentric portion of a rotation shaft supported in the bearing unit, performs an orbital motion inside the cylinder along a cylinder inner wall of the cylinder, and forms an operation chamber together with the cylinder inner wall, and a vane which protrudes from the inside of a vane groove of the cylinder to the inside of the operation chamber, comes into contact with the annular piston, and partitions the operation chamber into an inlet chamber and a compression chamber, and that performs suction of the refrigerant via the inlet unit and discharges the refrigerant from the discharge portion via the inside of the compressor housing; and a motor that is disposed in the upper section of the compressor housing and drives the compressing unit via the rotation shaft, wherein the vane is formed of steel and has a diamond-like carbon layer formed on a sliding surface with respect to the annular piston, and wherein the annular piston is formed of Ni—Cr—Mo cast iron to which 0.15 wt % to 0.45 wt % of phosphorus is added, or is formed of cast iron or steel and has an iron nitride layer formed only on an outer circumferential surface thereof, and a nitriding treatment is not performed on an inner circumferential surface thereof.

2. The rotary compressor according to claim 1, wherein, between a base member and the diamond-like carbon layer of the vane, any one layer of a layer of which a ratio of SP3/SP2 is 5 or less, a CrN layer, and a nitride layer is formed as a joint layer.

3. A rotary compressor comprising:

a vertically-positioned airtight compressor housing having an upper section in which a discharge portion of a refrigerant is provided and a lower section in which an inlet unit of the refrigerant is provided on a side surface thereof;

a compressing unit that is disposed in the lower section of the compressor housing, that includes an annular cylinder, an end plate which has a bearing unit and a discharge valve unit and closes an end portion of the cylinder, an annular piston which is fit in an eccentric portion of a rotation shaft supported in the bearing unit, performs an orbital motion inside the cylinder along a cylinder inner wall of the cylinder, and forms an operation chamber together with the cylinder inner wall, and a vane which protrudes from the inside of a vane groove of the cylinder to the inside of the operation chamber, comes into contact with the annular piston, and partitions the operation chamber into an inlet chamber and a compression chamber, and that performs suction of the refrigerant via the inlet unit and discharges the refrigerant from the discharge portion via the inside of the compressor housing; and a motor that is disposed in the upper section of the compressor housing and drives the compressing unit via the rotation shaft, wherein the vane is formed of steel and has a diamond-like carbon layer having HmV of 1500 or higher which is formed as an under layer on a sliding surf ace with respect to the annular piston and a diamond-like carbon layer having HmV of 1200 or lower which is formed as a fitness layer on an outer side of the diamond-like carbon layer having HmV of 1500 or higher, and wherein the annular piston is formed of Ni—Cr—Mo cast iron or Ni—Cr—Mo cast iron to which 0.15 wt % to 0.45 wt % of phosphorus is added, or is formed of cast iron or steel and has an iron nitride layer formed only on an outer circumferential surface thereof, and a nitriding treatment is not performed on an inner circumferential surface thereof.

4. The rotary compressor according to claim 3, wherein, between a base member and the diamond-like carbon layer having HmV of 1500 or higher as the under layer of the vane, any one layer of a layer of which a ratio of SP3/SP2 is 5 or less, a CrN layer, and a nitride layer is formed as a joint layer.

5. The rotary compressor according to claim 3, wherein the diamond-like carbon layer having HmV of 1200 or lower as the fitness layer is formed by mixing a metal or chemical element thereto in addition to having a diamond bond and a graphite bond.

* * * * *